US005397633A

United States Patent [19]

McAbee et al.

[11] Patent Number: 5,397,633

[45] Date of Patent: Mar. 14, 1995

[54] PROCESS FOR SIZING SPUN COTTON YARNS

[75] Inventors: Michael L. McAbee, Cataula; Donald H. Shomake, Buford, both of Ga.

[73] Assignee: Exxon Chemical Patents, Inc., Linden, N.J.

[21] Appl. No.: 80,064

[22] Filed: Jun. 18, 1993

[51] Int. Cl.[6] ..... B32B 23/00

[52] U.S. Cl. ..... 428/290; 8/495; 427/389.9; 427/392

[58] Field of Search ..... 8/495; 427/389.9, 392; 428/290

[56] References Cited

U.S. PATENT DOCUMENTS 4,410,588 10/1983 Ling ..... 427/389.9 X
4,515,855 5/1985 Ling ..... 427/389.9 X
4,605,418 8/1986 Christie et al. ..... 8/495 X
4,702,742 10/1987 Iwata et al. ..... 8/495
4,997,519 3/1991 Kondo et al. ..... 427/389.9 X

*Primary Examiner*—Michael Lusignan
*Attorney, Agent, or Firm*—J. J. Mahon

[57] ABSTRACT

This invention is to a process for sizing spun cotton yarns, especially dyed spun cotton yarns. The process entails treating a cotton-containing yarn with a solution polyacrylamide polymer. The use of this polymer system with a spun cotton yarn has been discovered both to overcome the previous excessive brittleness which had precluded use of polyacrylamide polymers as a size and to produce a fabric which can be overdyed without prior removal of the size.

9 Claims, No Drawings

PROCESS FOR SIZING SPUN COTTON YARNS

BACKGROUND OF THE INVENTION

This invention is directed to the sizing of spun cotton yarns, particularly dyed spun cotton yarns, by treatment of the yarns prior to weaving with a low molecular weight polyacrylamide solution-polymerized polymer.

The use of variuous compounds as sizing agents for warp yarns to prevent breakage of the yarn during weaving is well known. The sizing agents are placed upon the warp yarns prior to weaving to provide strength and protection to the yarns from abrasion. Traditional sizing agents for cotton-containing yarns have generally included film formers such as starch, derivatives of starch, polyvinyl alcohol, polyester resins, waxes, acrylic polymers and copolymers and their salts, wetting agents, antistatic agents, and the like. Current commercial sizes are predominantly based upon starch in combination with one or more of polyvinyl alcohol, polyester resins, acrylic copolymer resins, and waxes.

A good sizing agent is one which will form a film with sufficient strength to provide protection to the yarn being sized but not so strong that the yarn will break before the size film. This is particularly important as yarns are generally sized in a size box, then the water removed on steam cans and the yarns form a sheet. Then this sheet of yarns is run across bust rods to break the sheet back into individual yarns for weaving.

Previous attempts to utilize polyacrylamide homopolymers as sizing agents have not been successful. For example, U.S. Pat. No. 4,515,855 claims the use of acrylamide copolymers and multipolymers with at least one monomeric compound containing a hydrophobic polymerizable reactive vinyl or vinylidene group but asserts that homopolymers of acrylamide impart only minor protection to fibers during weaving. Example 11 pads a polyacrylamide polymer solution unto single-end 100% untreated cotton yarns. No indication of the type of polyacrylamide polymer nor its molecular weight are provided. Evaluation of the polyacrylamide padded yarns indicate little difference in performance vs. starch alone and substantially inferior performance as compared to the claimed copolymers and multipolymers. U.S. Pat. No. 4,410,588 contains a similar statement on acrylamide homopolymers but also contains no details thereon.

Since the prior sizing agents have not been completely adequate for use in processing spun yarns, it is an object of the present invention to overcome certain of the deficiencies of the prior sizes, particularly in the processing of dyed spun cotton yarns, and more particularly when such yarns are to be overdyed.

Furthermore, with the increasing levels of both general environmental concern and garment processing in the denim industry, e.g. stone washing, pre-washing, and the like, it is an object of the present invention to utilize a more readily degradable sizing agent, i.e. one which has a reduced biological oxygen demand (BOD) and a reduced chemical oxygen demand (COD).

It is a still further object of the invention to develop an effective non-ionic sizing agent which will permit the utilization of cationic fixing agents such as polyamine and polyamide polymers.

It is a still further object of the invention to develop a sizing agent which does not get tacky or sticky in the presence of the very high moisture levels which are commonly present in weaving rooms.

These and still further objects will be apparent from the detailed description of the invention which follows.

SUMMARY OF THE INVENTION

Accordingly, the present invention is directed to a method of sizing a spun cotton yarn substrate by applying to the substrate an aqueous solution consisting essentially of a polyacrylamide polymer which has a viscosity of about 400 to 900 cps at 20% solids and thereafter drying the treated substrate, said polymer being applied in an amount sufficient to impart a high order of abrasion resistance to the yarn while being capable of being removed from the yarn by aqueous washing, preferably to increase the weaving efficiency of the yarn substrate by at least about 3% as compared to conventional starch sizing agent compositions. When the spun cotton yarn substrate is a dyed spun yarn, suitable such amounts are generally about 4 to 8 wt %, based on the weight of the yarn. When the spun cotton yarn substrates are towel pile yarns, suitable such amounts are about 2.25 to 4 wt %. Both insufficient and excessive amounts of size have been found to reduce the weaving efficiency to below the level obtained by following the present invention.

As a result of this invention, weaving efficiency is substantially increased while simultaneously reducing the amount of sizing agent required. This economical treatment produces a sized yarn which is also more environmentally friendly than previous sized yarns in view of the very low BOD and COD values of the resulting fabric.

DESCRIPTION OF THE PREFERRED EMBODIMENTS

The present invention involves the use of an aqueous solution consisting essentially of a narrow class of non-ionic polyacrylamide homopolymers as a sizing agent for spun cotton yarns.

Suitable polyacrylamide homopolymers for use herein are those which have been produced by a solution polymerization procedure, as opposed to a bulk or suspension or emulsion or inverse emulsion polymerization technique. The solution polymerized polyacrylamide homopolymers have a low molecular weight as evidenced by a viscosity of a 20 wt % aqueous solution thereof being only about 400 to about 900 cps, preferably about 500 to about 800 cps, as determined by a Brookfield RVT Viscometer at 25° C. using spindle #3 at 50 RPM. It is believed that this viscosity corresponds to a molecular weight in the range of about 30,000 to about 180,000 daltons. Care should be taken to prevent hydrolysis of the polyacrylamide polymer as the presence of acid groups has been found to be deleterious to the performance of the sizing agent, particularly in the high moisture levels commonly found in weaving rooms to facilitate the weaving process.

Any conventional acrylamide solution polymerization technique may be used to prepare the solution polyacrylamide polymers used herein. Generally, acrylamide monomer is polymerized in an aqueous medium, under an inert atmosphere, and in the presence of a catalytic amount of a free-radical source such as ammonium persulfate, ammonium persulfate and sodium bisulfite, and the like. The reaction mixture is stirred under the inert atmosphere until the polymerization is completed.

The resulting product is a slightly viscous solution which, depending upon its solids content, may be directly used in the present invention or may need to be diluted to a lower solids level. A particularly suitable such polymer is available from Callaway Chemical Company as Callaway 4600. Although it is possible to incorporate starch, polyvinyl alcohol, waxes, and other sizing agents along with the polyacrylamide homopolymer in a sizing composition, such is not preferred. Similarly, other conventional sizing additives, such as binders, lubricants, plasticizers, and the like, may be added but are also not preferred. Most preferably, the cotton yarns are sized with a simple polyacrylamide solution polymer in water.

The solution polyacrylamide polymer is applied to spun cotton yarn in an amount sufficient to impart a high order of abrasion resistance to the yarn while being capable of being removed from the yarn by aqueous washing, preferably in an amount to increase the weaving efficiency of the yarn substrate by at least about 3% as compared to a conventionally used starch sizing agent. The standard is determined by averaging the weaving efficiency of all of the looms preparing the same type product at the time a mill trial is performed with the sizing agent of this invention. Generally such conventional sizing agents include starch often in combination with one or more of polyvinyl alcohol, acrylic binders, waxes, acrylic copolymers, and the like. When the spun cotton yarn substrate is a dyed spun yarn, a suitable such amount is about 4 to 8 wt %, based on the weight of the yarn. When the spun cotton yarn substrate is undyed towel pile yarns, a suitable such amount is about 2.25 to 4 wt %. Both insufficient amounts of size have been found to reduce the weaving efficiency to below the at least about 3% increase obtained by following the present invention. Excessive amounts of size which may also reduce weaving efficiency have also been found to deleteriously effect the performance of the constructed fabric, in some cases because of increased lubrication and removal efficiency as compared to current sized fabrics during garment processing.

The application of the solution polyacrylamide polymer to the spun cotton yarns is by conventional padding, spraying, knife coating, and the like. Preferably, the yarn is beamed on a reel and run through a size box and squeeze rollers set to deposit the desired level of sizing agent solids. Thereafter, the treated yarns are dried, routinely by heating to an elevated temperature for a short period of time on steam cans. The resulting yarns are in the form of a sheet which is run across bust rods to break the yarn sheet back into individual yarns for weaving.

Suitable cotton yarns for use herein are spun yarns which include ring spun, open-end, and air-jet yarns. The spun yarns may be cotton or a blend of cotton and some other fiber.

The process of this invention produces a size coating on spun cotton yarns which is characterized by easy removal in subsequent washing. More particularly, the effluent from that washing is far less detrimental to the environment than current commercial sizing products. The approximate biological oxygen demand and the chemical oxygen demand for the solution polyacrylamide homopolymers used herein vs. conventional sizes are as follows:

TABLE I

| Sizing agent | BOD (mg/l) | COD (mg/l) |
|---|---|---|
| Solution polyacrylamide | 8,000 | 160,000–421,000 |
| Starch | 650,000 | 1,500,000 |
| Polyvinyl alcohol | 16,000 | 70,400–720,000 |

The treated textile substrates are further characterized by generally requiring less total sizing agent then is currently commercially used. For example, with traditional size formulations used with a dyed yarn, about 9–14 wt % size is commonly used to give a sufficient degree of protection during weaving. Superior results in actual field trials with the present invention have been obtained at only 4–8 wt % solution polyacrylamide polymer. Similarly, with traditional size formulations used with undyed towel pile yarn, about 5–7 wt % size is commonly used while the present invention enables the use of about 2.25–4 wt % size.

When the spun yarn substrate has been pre-dyed, as is common in denim processing, the fabric produced after weaving and/or the garments produced therefrom can be directly overdyed without the need for prior removal of the sizing agent. Of course, the size may be removed prior to overdyeing.

The following examples are illustrative of the process of the present invention and not in limitation thereof. All parts and percents are by weight unless otherwise specified.

EXAMPLE 1

190.5 g of aqueous acrylamide (52.5% real solids) was added to 300.0 g water in a suitable reaction vessel with sufficient agitation to create a distinct vortex. Nitrogen sparging was begun and a solution of 0.36 g sodium hypophosphite in 5.1 g water was charged into the reaction vessel. The reaction mixture was heated slightly to a temperature of 23°–26° C. and then the nitrogen was changed from a sparge to a blanket. 0.96 g of ammonium persulfate was added and within 20 seconds a premixed solution of 0.14 g sodium metabisulfite in 1.2 g water was also added. Thereafter the reaction vessel was sealed off and the polymerization reaction occurred. Adequate cooling was used to maintain the reaction temperature between 80° and 90° C. After the exotherm subsided, a solution of 0.02 g sodium metabisulfite in 0.25 g water was added, the cooling was turned off, and the reaction mixture held for 45 minutes. After cooling to 50°–55° C. the pH was adjusted to 5–7 with caustic soda and the solution diluted to 20 wt % solids. The resulting dilute polymer solution had a viscosity of 650 centipoise as determined by Brookfield RVT Viscometer, spindle no. 3, 50 RPM, 25° C.

EXAMPLE 2

A field trial of the process of the present invention was performed by mixing 600 pounds of a diluted solution polyacrylamide polymer prepared as described in Example 1 with 190 gallons of water and adding it to a size box. The size mix was not cooked but was heated to 200°–205° F. (93°–96°C.) in a size box during the application. Sulfur black dyed open-end yarn (6's), 100% cotton, 14¾ oz. fabric, was passed through the size box and then was squeezed with rollers to add on 5.3% of solution polyacrylamide polymer. After drying on steam cans, the resulting sheet of yarns was run across bust rods (slasher) to break the sheet back into individual yarns for weaving.

No problems occurred on the slasher and a weaving trial was performed. At the same time as the trial, the mill was running 40 other looms of the same spun yarn which had been sized in accordance with the mill's conventional starch based sizing composition for this yarn. The conventional composition was a mixture of 350 pounds starch, 86 pounds acrylic emulsion polymer, and 160 gallons water. The weaving efficiency of the loom utilizing the sizing agent of this invention was 94.5%. The average weaving efficiency of the conventionally sized looms was 91.4%. The weaving efficiency is determined by dividing the number of theoretical picks into the actual number of picks run (a pick occurs every time a filling yarn is inserted into the fabric). When a yarn breaks the loom stops, reducing the number of picks run per unit time. Types of yarn breaks are characterized and counted to give a loom efficiency and also to determine the level of defects (breaks) which are warp-related and which are fill-related (fill yarn contains no size).

Portions of the fabric produced in accordance with the present invention and the fabric produced with the conventional starch-based size were subjected to overdyeing. The fabric produced by this invention was overdyed without desizing. The conventional starch sized fabric was desized before overdyeing. The invention fabric met the dye shade standard and showed no size spots (defects in the overdyed fabric). The desized conventional fabric was overdyed in accordance with convention practice and, although found to meet the dye shade standard, contained size spots (defects) because of incomplete removal of size.

EXAMPLE 3

The procedure of Example 2 was again repeated except that (i) the yarn sized was 6's indigo dyed, 100% cotton ring spun yarn 14¾°ounce fabric, (ii) 575 pounds of the 20% polyacrylamide polymer solution was initially blended with 211 gallons of water, (iii) the polyacrylamide solution polymer add on was 4.9%, and (iv) the size mix was not cooked or heated but rather was run at ambient temperature.

The results of a weaving trial in comparison with 200 looms of conventionally starch-sized yarn composed of 300 pounds starch, 40 pounds polyvinyl alcohol, 20 pounds of paste wax, and 206 gallons water. The add-on was a standard 12%. The trial showed that the weaving efficiency of the yarn treated in accordance with the present invention was 99.3% while the average of the conventional starch-treated yarns was only 94.0%.

EXAMPLE 4

The procedure of Example 2 was again repeated except that (i) the yarn sized was 6's indigo dyed open end yarn, 100% cotton 12 ounce fabric, (ii) 300 pounds of the 20% polyacrylamide polymer solution was initially blended with 95 gallons of water, and (iii) the polyacrylamide solution polymer add on was 7.1%.

The results of a weaving trial in comparison with 100 looms of conventionally sized yarn composed of 250 pounds of starch, 50 pounds acrylic emulsion polymer, 25 pounds of wax, and 230 gallons of water, showed that the weaving efficiency of the yarn treated in accordance with the present invention was 92% while the average of the conventionally treated yarns was only 88%.

COMPARATIVE EXAMPLE A

The procedure of Example 2 was again repeated except that (i) the yarn sized was 6's indigo dyed open-end yarn, 100% cotton 14¾°ounce fabric, (ii) 660 pounds of the 20% polyacrylamide polymer solution was initially blended with 140 gallons of water, and (iii) the polyacrylamide solution polymer add on was 11.64%.

The results of a weaving trial in comparison with 100 looms of conventionally sized yarn composed of 250 pounds of starch, 50 pounds acrylic emulsion polymer, 25 pounds of wax, and 230 gallons of water, showed that the weaving efficiency of the yarn treated with the solution polyacrylamide polymer was substantially the same as that of the conventionally treated yarn, i.e. no difference was found.

When the resulting fabric with the solution polyacrylamide polymer size on it was garment washed and bleached with hypochlorite, the fabric appeared lighter and more varied than the fabric from the same dye set that had been conventionally-sized.

COMPARATIVE EXAMPLE B

The procedure of Example 2 was again repeated except that (i) the yarn sized was 6's indigo dyed open-end denim, (ii) 500 pounds of the 20% polyacrylamide polymer solution was initially blended with 300 gallons of water, and (iii) the polyacrylamide solution polymer add on was 3.3%.

The results of a weaving trial in comparison with 125 looms of conventionally sized yarn composed of 450 pounds starch, 100 pounds of a dry blend believed to be a mixture of wax, urea, and polyvinyl alcohol, and 330 gallons water, showed that the yarn treated with the polyacrylamide solution polymer did not weave well because the warp was too soft to protect the yarn.

COMPARATIVE EXAMPLE C

The basic procedure of Example 2 was again repeated except that (i) the size was added to undyed towel pile yarns which were 16's open-end yarns, (ii) 250 pounds of the 20% polyacrylamide polymer solution was initially blended with 300 gallons of water, and (iii) the polyacrylamide solution polymer add on was 1.52%.

A weaving trial was performed. Although the weaving efficiency was a reasonable 92%, there was a considerable amount of fiber shedding as well as an increase in the warp breaks in the towel selvage (border area), both of which caused the trial to fail.

EXAMPLE 5

The procedure of Comparative Example C was repeated except that the amount of size on the towel pile yarns was increased to 2.9%. The resulting weaving shows an efficiency greater than 95% and little to no fiber shedding was observed and warp breaks in the selvage were normal or below.

What is claimed is:

1. A process for sizing a spun cotton yarn substrate comprising applying to the substrate an aqueous solution consisting essentially of a solution polymerized polyacrylamide homopolymer which has a viscosity of about 400 to 900 cps at 20% solids and thereafter drying the treated substrate, said homopolymer being applied in an amount sufficient to impart comprising abrasion resistance to the yarn while being capable of being removed from the yarn by aqueous washing.

2. The process of claim 1, wherein the amount is sufficient to improve the weaving efficiency of the yarn substrate by at least about 3% as compared to a conventional starch size composition.

3. The process of claim 1, wherein the cotton yarn has been dyed prior to sizing and the amount is about 4 to 8 wt %, based on the weight of the yarn.

4. The process of claim 3, wherein after the dyed cotton yarn is sized, it is further processed by the steps of weaving it into a fabric and then overdyeing without removal of the solution polyacrylamide polymer.

5. The process of claim 1, wherein the cotton yarn is an undyed towel pile yarn and the amount is about 2.25 to 4 wt %.

6. The process of claim 1, wherein the spun cotton yarn is selected from the group consisting of ring spun, open-end, and air-jet yarns.

7. The process of claim 1, wherein the viscosity is about 500 to 800 centipoise.

8. The treated yarn of claim 3.

9. The overdyed woven fabric of claim 4.

* * * * *